US008196238B2

(12) United States Patent
Hejkal et al.

(10) Patent No.: US 8,196,238 B2
(45) Date of Patent: Jun. 12, 2012

(54) ROTATABLE SURGERY TABLE

(76) Inventors: Thomas Hejkal, Omaha, NE (US); Kimberly Ryland, Omaha, NE (US); Carl Nelson, Lincoln, NE (US)

( * ) Notice: Subject to any disclaimer, the term of this patent is extended or adjusted under 35 U.S.C. 154(b) by 0 days.

(21) Appl. No.: 13/168,729

(22) Filed: Jun. 24, 2011

(65) Prior Publication Data

US 2011/0252564 A1 Oct. 20, 2011

Related U.S. Application Data

(63) Continuation of application No. 12/208,922, filed on Sep. 11, 2008, now Pat. No. 7,992,238.

(60) Provisional application No. 60/972,054, filed on Sep. 13, 2007.

(51) Int. Cl.
*A61G 13/12* (2006.01)

(52) U.S. Cl. ..... 5/603; 5/655; 5/507.1; 128/845; 128/847

(58) Field of Classification Search ..... 5/8, 600, 5/601, 603–607, 620, 621, 95, 96, 655, 173, 5/658, 503.1, 507.1; 600/21, 22; 128/845, 128/847; 108/49, 50.18, 94
See application file for complete search history.

(56) References Cited

U.S. PATENT DOCUMENTS 2,904,798 A * 9/1959 Heflin ..... 5/621
3,543,312 A * 12/1970 Pofferi ..... 108/49
3,615,088 A 10/1971 Compton
3,892,399 A * 7/1975 Cabansag ..... 378/174
4,151,812 A 5/1979 Miller
D317,571 S 6/1991 Henrikson
5,287,575 A * 2/1994 Allen et al. ..... 5/623
5,329,934 A 7/1994 Bowman
5,359,741 A * 11/1994 Lang ..... 5/507.1
6,155,970 A 12/2000 Dykes et al.
6,457,196 B1 * 10/2002 Dykes et al. ..... 5/655
6,928,676 B1 8/2005 Schwaegerle
7,082,882 B2 * 8/2006 Heimbrock ..... 108/49
7,992,238 B2 * 8/2011 Hejkal et al. ..... 5/603

OTHER PUBLICATIONS

Steris Corporation, Healthcare Products, The Giraffe Platform from GE, online printouts, 15 pages, Oct. 20, 2006.

* cited by examiner

*Primary Examiner* — Michael Trettel
(74) *Attorney, Agent, or Firm* — Bracewell & Giuliani LLP

(57) ABSTRACT

A surgical table for infants and small animals has a bed assembly that is rotatable. The bed assembly includes a stationary plate and a rotating plate with a brake that controls rotation. The bed assembly may be connected by a clamp to the frame of a conventional operating table and supported alongside or above. The bed assembly may also be permanently mounted on its own vertical support. The bed assembly may also be permanently mounted to the operating table by an articulated clamp that allows the bed assembly to be stored alongside. A central opening is present in both plates so that hoses and wires connected to the patient will pass through this opening to permit rotation of the patient with the table with no stress on the hoses or wires where they connect to the patient.

21 Claims, 8 Drawing Sheets

6

19
19
15
17
6
21
11
47
51
49
53

Fig. 14
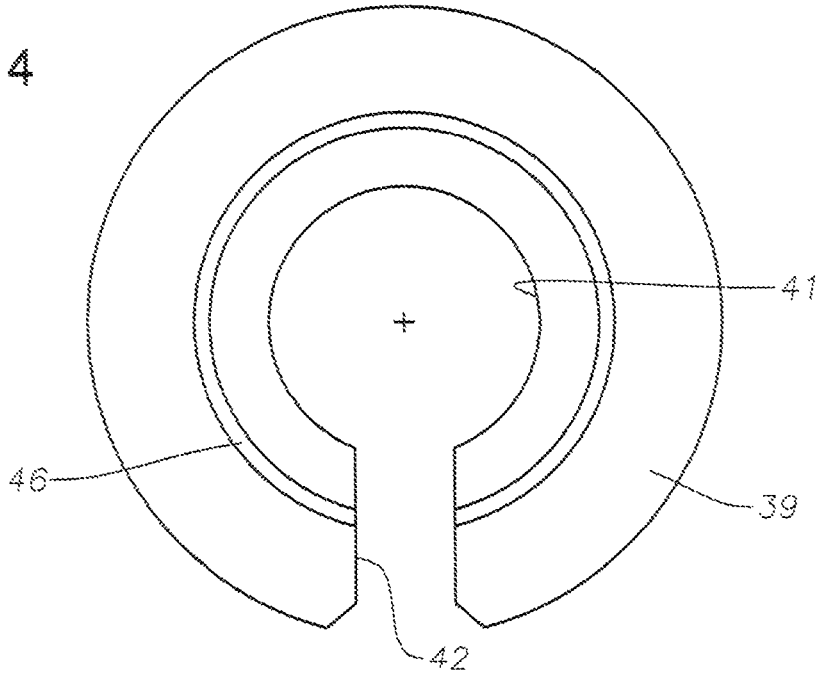
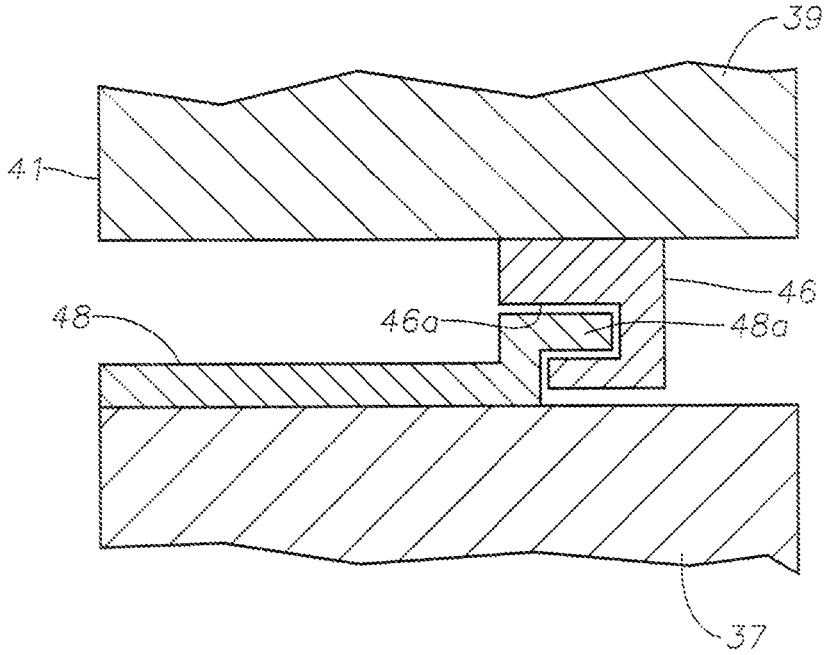
Fig. 15

ROTATABLE SURGERY TABLE

CROSS-REFERENCE TO RELATED APPLICATION

This application is a continuation of U.S. application Ser. No. 12/208,922, filed Sep. 11, 2008 and now U.S. Pat. No. 7,992,238.

This application claims priority to provisional application 60/972,054, filed Sep. 13, 2007.

FIELD OF THE INVENTION

This invention relates in general to medical operating tables and in particular to a small rotatable table, such as for infants and small animals.

BACKGROUND OF THE INVENTION

Certain surgical procedures performed on infants introduce novel problems in regard to patient positioning and access by the physician. For example, the surgical procedure for treating retinopathy of prematurity employs laser photo coagulation for an infant's eyes. Current practices utilize typical surgery tables on which the infant is positioned. This positioning requires the physician to continuously move around the table and commonly take on physical positions that are awkward in order to have access to all parts of the infant's eye with the laser. Normally the infant is not moved or repositioned during the procedure because of the various tubes, hoses and monitors connected to the infant. The awkward movements required can result in injury to the physician over time and also decrease the efficiency of the procedure.

Small auxiliary tables that attach to the side or end of an operating table for performing medical procedures on infants are known. However, these tables still require the physician to assume awkward positions. Other medical procedures performed on infants, in addition to retinal laser photocoagulation, present similar access problems. Access can also be a problem for certain medical procedures performed on small animals.

SUMMARY OF INVENTION

In this invention, the medical procedure table includes a bed assembly that is mounted rotatably to a stationary base or supporting member. The patient is placed in a fixed position on the bed assembly and at least flexible link such as an anesthesia hose and/or an instrument electrical lead or cord are attached to the patient. The supporting member has an opening through which the flexible link is routed. The bed assembly is rotated relative to the stationary base to various positions while the hose and instrument cords remain attached to allow the physician to perform various procedures on the patient.

In the first embodiment, the base is attached to a larger, conventional surgical or operating table and cantilever-supported alongside the operating table. While not in use, the smaller table may be quickly released from the operating table and stored. In another embodiment, the smaller rotatable table remains attached to the larger operating table. In that embodiment, the smaller table is connected by an articulated arm to the larger operating table. The bed assembly may be folded from an operational position above the operating table to a storage position alongside the operating table with the bed oriented vertically. The rotatable bed assembly may also be permanently mounted to its own vertical support rather than attached to a larger operating table.

In each embodiment, the bed assembly preferably has a brake that mounts between rotating and stationary members. Preferably, the brake is biased to a brake position and allows rotation only when the brake is manually released.

In the preferred embodiment, the bed assembly includes rotatable and stationary plates mounted to a frame. The bed is preferably supported above the rotatable plate by a plurality of columns. Each of the stationary and rotatable plates has a large, central aperture to allow the operating personnel to pass tubes, hoses and electrical cords.

BRIEF DESCRIPTION OF DRAWINGS

FIG. 14 is a bottom view of the rotatable plate of the bed assembly of FIG. 1.

FIG. 15 is a partial enlarged sectional view of the rotatable and stationary plates of FIG. 1, illustrating the bearing arrangement.

DETAILED DESCRIPTION OF INVENTION

Figure 1:
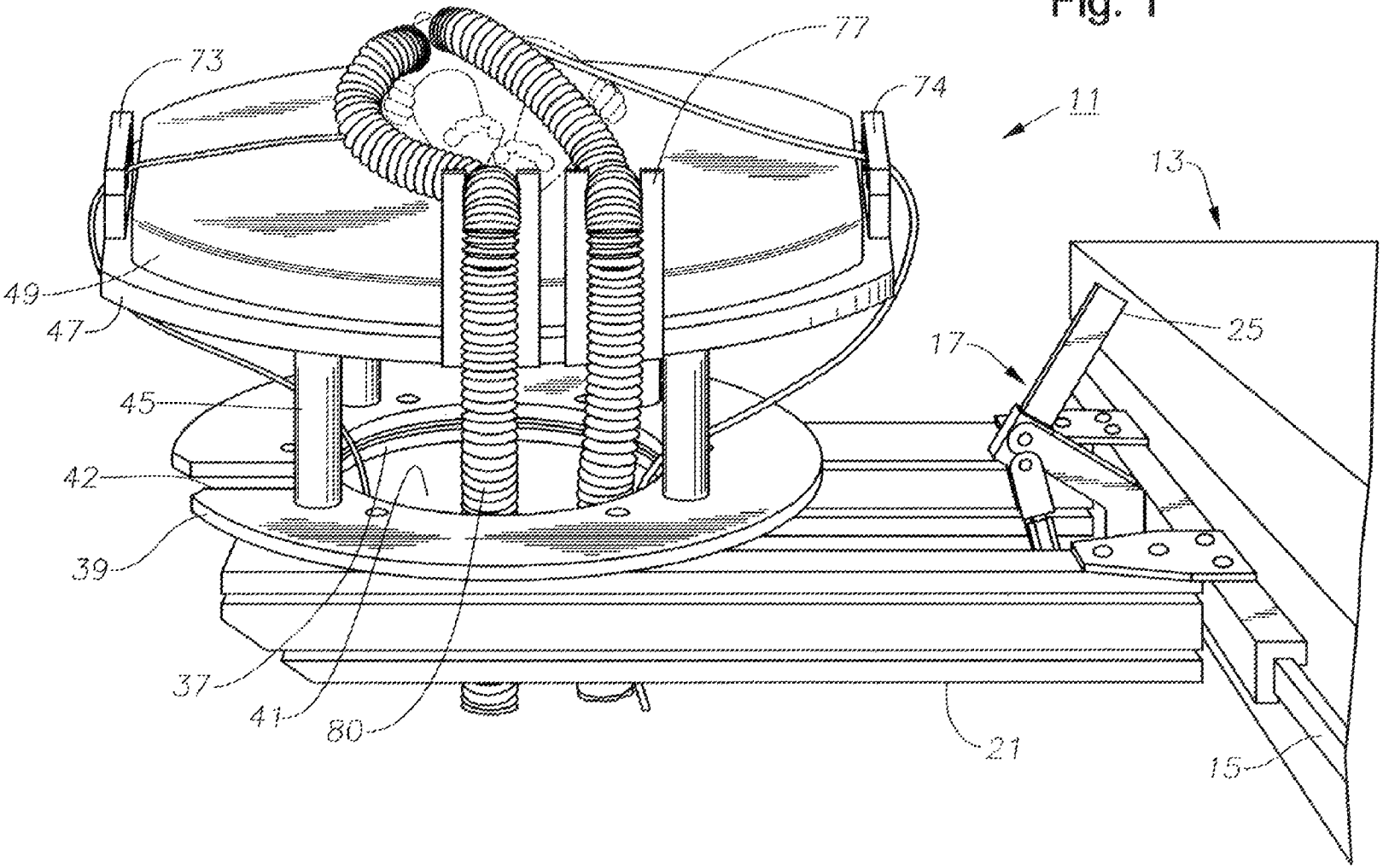
FIG. 1 is a perspective view illustrating a rotatable bed assembly constructed in accordance with this invention and shown clamped to a conventional operating table.

Referring to FIG. 1, an auxiliary or small patient bed assembly 11 is shown being supported by a conventional operating table 13. Operating table 13 is of a type that is used for performing surgical procedures on patients. Typically, operating table 13 is able to move upward and downward as well as tilt to various positions. Operating table 13 normally has a side rail 15 on each side.

Figure 4:
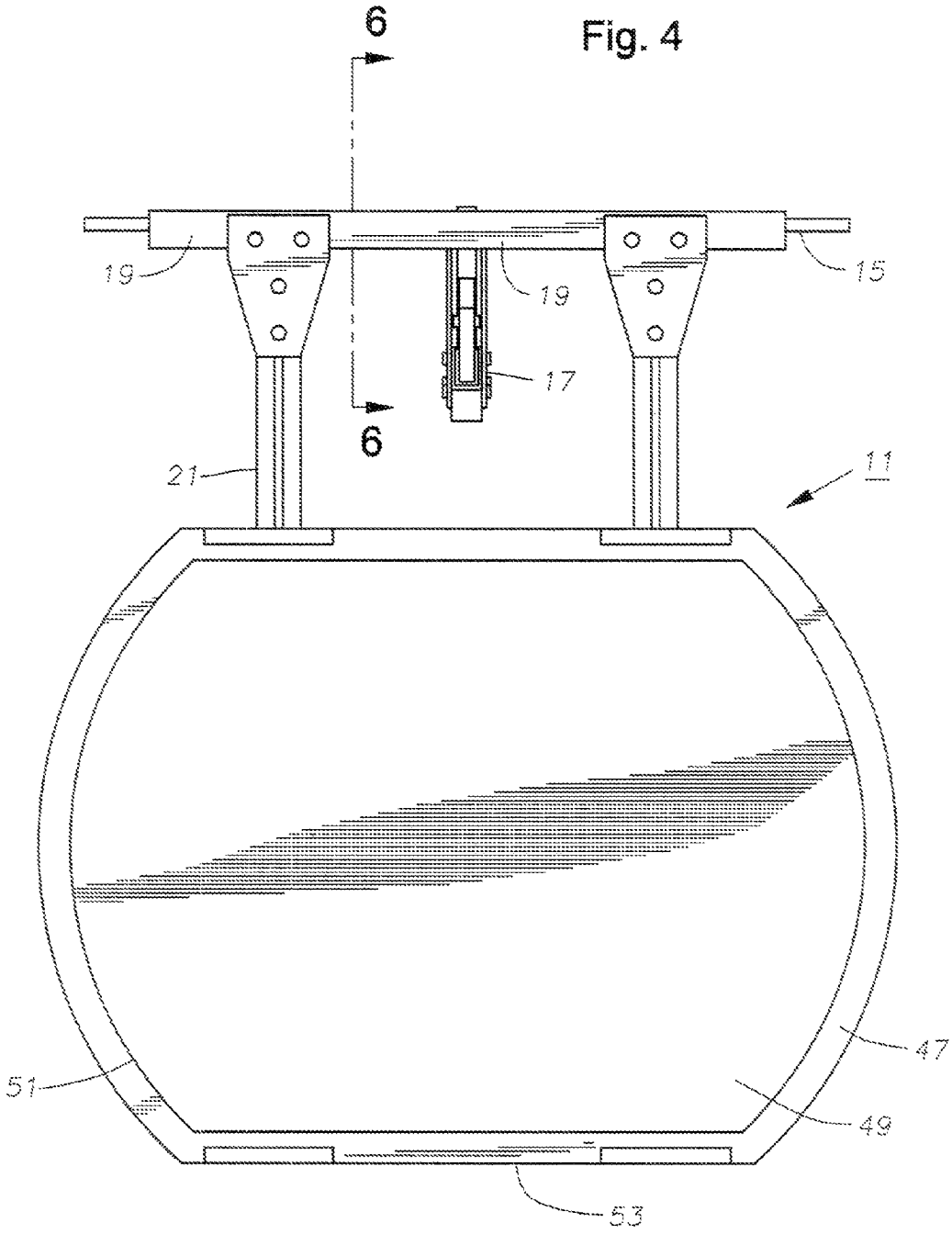
FIG. 4 is a top view of the bed assembly of FIG. 1.

Bed assembly 11 has a connector for releasably connecting it to operating table 13, which in this example is a toggle clamp assembly 17 that clamps to side rail 15 of operating table 13. Toggle clamp assembly 17 is mounted to a stationary frame or base of bed assembly 11, which in this embodiment includes a cross member 19, as shown in FIG. 4. The stationary frame also includes two frame members or rails 21, which are attached to and extend perpendicular to cross member 19.

Figure 6:
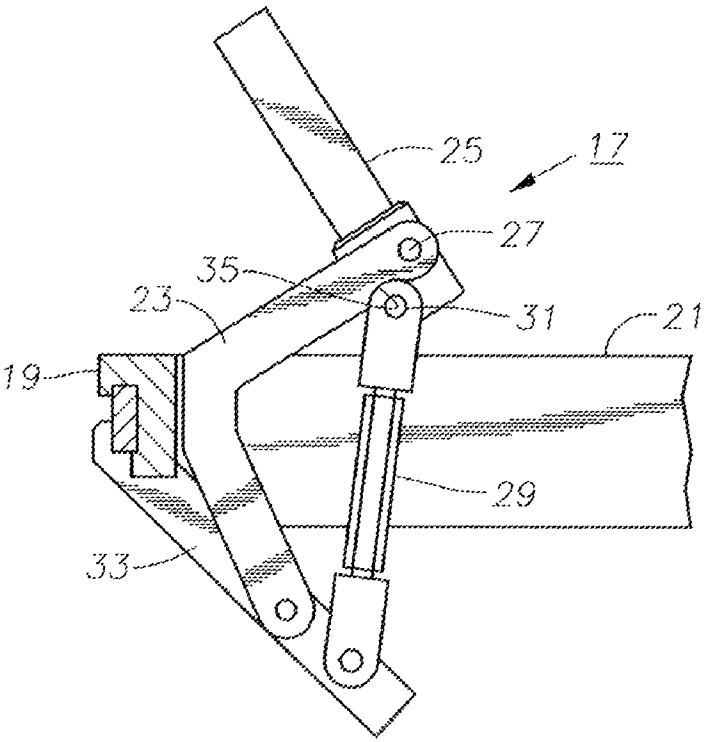
FIG. 6 is an enlarged sectional view of the clamp member for the bed assembly of FIG. 1, taken along the line 6-6 of FIG. 4.

Referring to FIG. 6, cross member 19 in this embodiment comprises an L-shaped angle member in transverse cross section, having an overhanging upper lip that rests on an upper edge of operating table side rail 15. Toggle clamp assembly 17 includes a brace, which is rigidly secured to cross member 19. The brace has upper and lower brace members 23 that join each other at a forward end, the forward end being welded or otherwise connected to cross member 19. Upper and lower brace members 23 are straight and extend from each other at an angle somewhat more than 90 degrees in this example. Toggle clamp assembly 17 has a handle 25 that is pivotally mounted to the upper brace member 23 by a pivot pin 27. Handle 25 is also pivotally mounted to a linkage member 29 by another pivot pin 31. The length of linkage member 29 is adjustable in this example. A jaw member 33 is pivotably secured to the lower end of linkage member 29 and also to the lower brace member 23. The upper brace member 23 has a curved recess 35 that receives the upper end of linkage 29, defining a stop when clamp assembly 17 is in the locked position shown in FIG. 6.

To release clamp assembly 17 from side rail 15, the operator rotates handle 25 counter-clockwise from the position shown in FIG. 6. This movement causes pivot pin 31 to move rearward and upward. Linkage member 29 moves to cause jaw 33 to pivot clockwise and move downward to release from side rail 15. When handle 25 is rotated clockwise, the reverse occurs. The clockwise movement of handle 25 is stopped by the engagement of the upper end of linkage member 29 with recess 35. The arrangement of pivot pins 27, 31 creates an over-center action to occur when handle recess 35 engages the end of linkage member 29 to lock clamp assembly 17 in position. Many other types of connectors of small patient bed assembly 11 to side rail 15 are feasible.

Figure 2:
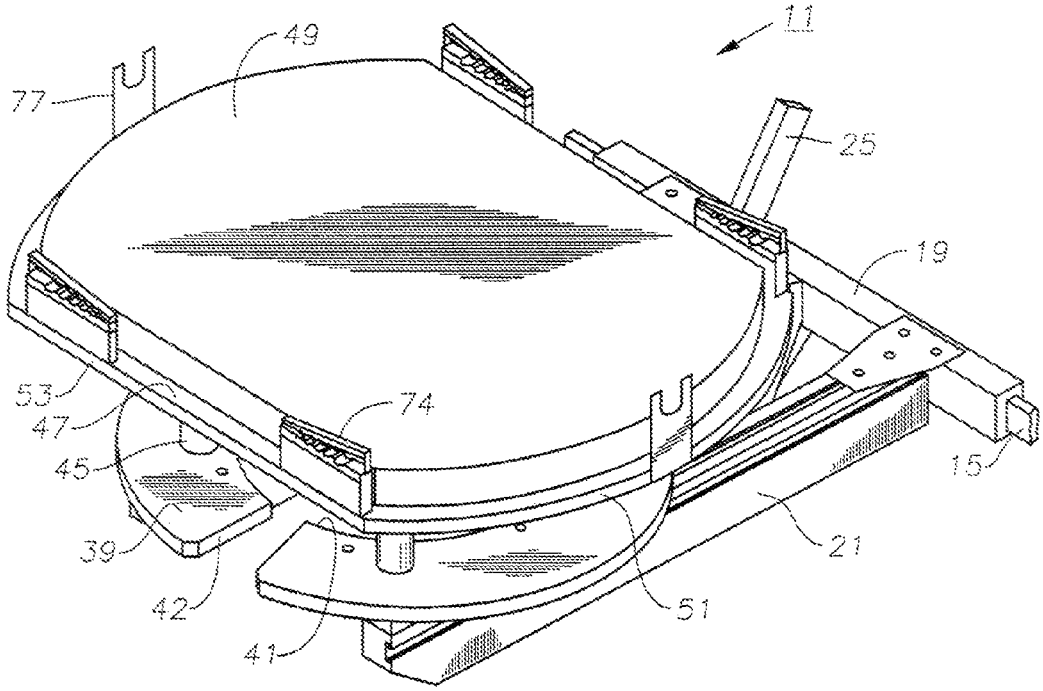
FIG. 2 is a perspective view of the bed assembly of FIG. 1, with the patient and various tubes and cords removed.
Figure 5:
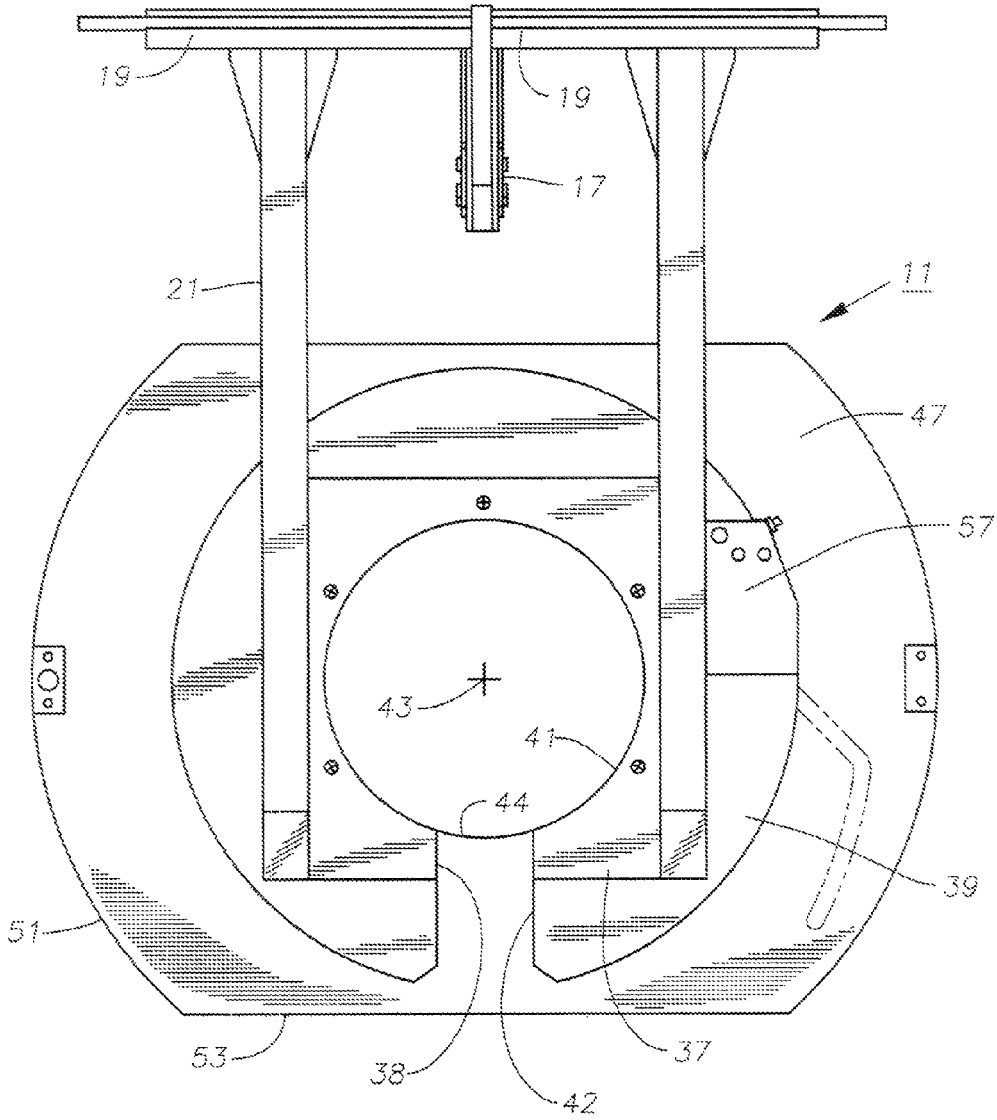
FIG. 5 is a bottom view of the bed assembly of FIG. 1.

Referring to FIG. 2, bed assembly 11 includes a turntable assembly for rotatably supporting it on frame members 21. The turntable assembly includes a stationary member or plate 37 that is rigidly secured to frame members 21. Stationary plate 37 and frame members 21 comprise a stationary base for bed assembly 11. Stationary plate 37 has a rectangular perimeter, as shown in FIG. 5, but it could be circular. The turntable assembly includes a rotatable member of plate 39, which is mounted over and parallel to stationary plate 37. Rotatable plate 39 has a circular perimeter or circumference in this example. As shown in the bottom view of FIG. 5, each of the stationary and rotatable plates 37, 39 has a large central hole 41. The axis of rotation 43 of rotatable plate 39 is centered in hole 41 in this embodiment.

A slot 33 extends from the edge of stationary plate 37 to hole 41. A slot 42 extends on a radial line from the circumference of rotatable plate 39 to hole 41. Slots 38 and 42 preferably have the same widths and will align with each other as shown in FIG. 5 when rotatable plate 39 is rotated to that particular position relative to stationary plate 37. Flexible tabs 44 may be secured to the inner diameter of hole 41 within stationary plate 37. One tab 44 extends partially across slot 38 from one side, and the other tab 44 extends partially across slot 38 from the other side. Tabs 44 overlap each other and will deflect inward when an object is pushed through slot 38 toward axis 43.

Referring to FIGS. 14 and 15, bearings are disposed between plates 37, 39 to allow rotatable plate 39 to freely rotate relative to stationary plate 37 while supporting a patient. The hearings could be a variety of types and in this embodiment comprises a journal arrangement. A circular upper bearing strip 46 is secured to the bottom of rotatable plate 39. Upper bearing strip 46 has an inner diameter larger than the diameter of hole 41 and smaller than the outer diameter of rotatable plate 39. A section of upper bearing strip 46 is removed at slot 42. Referring to FIG. 15, upper hearing strip 46 has an inward facing recess 46 formed therein.

At least one lower bearing strip 48 is secured to the upper side of stationary plate 37. Lower bearing strip 48 could be a single circular strip similar to upper hearing strip 48, but in the preferred embodiment comprise two or more strips that extend along partially around opening 41. Lower hearing strip 48 has an outward extending flange **48*a* that fits within cavity 46*a* so that rotation of rotatable plate 39 causes upper bearing strip 46 to slide relative to lower bearing strip 48. Weight on rotatable plate 39 transmits from upper hearing strip 46 through flange 48*a* to stationary plate 37. Preferably upper bearing strip 46 does not contact the upper surface of stationary plate 37**.

Figure 3:
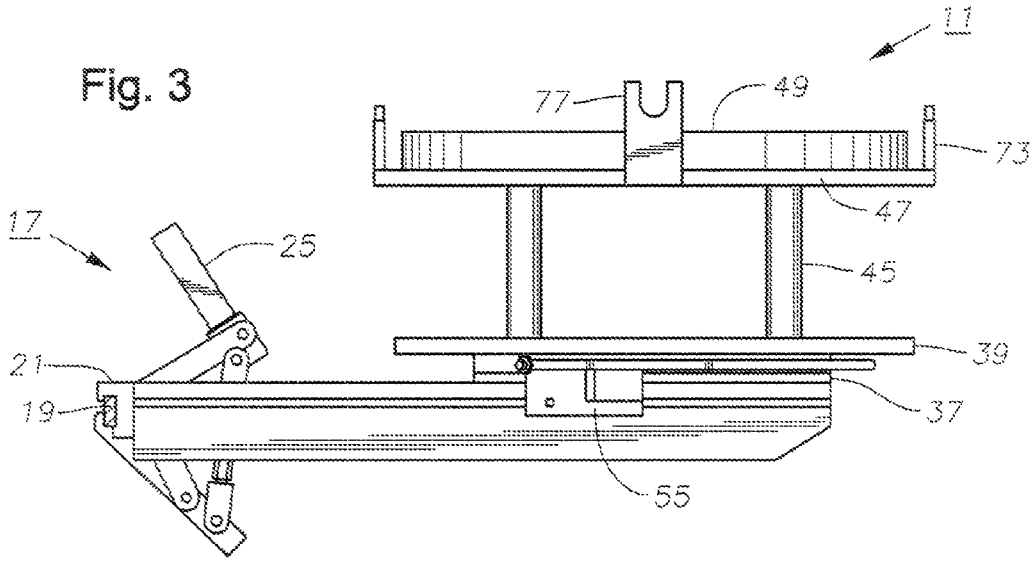
FIG. 3 is a side view of the bed assembly of FIG. 1.

Referring to FIG. 3, in this embodiment, bed assembly 11 includes a standoff member comprising in this embodiment a plurality of upward extending vertical columns 45 secured to rotatable plate 39 for rotation therewith. A bed 47 is mounted to the upper ends of columns 45, thereby placing bed 47 in a plane parallel with the planes containing stationary plate 37 and rotatable plate 39. Referring to FIG. 5, in this example, bed 47 has two curved sides 51, each being formed at the same radius from axis 43, and two straight sides 53 that are opposite and parallel to each other. A mattress pad 49 (FIG. 1) is typically placed on bed 47.

Figure 7:
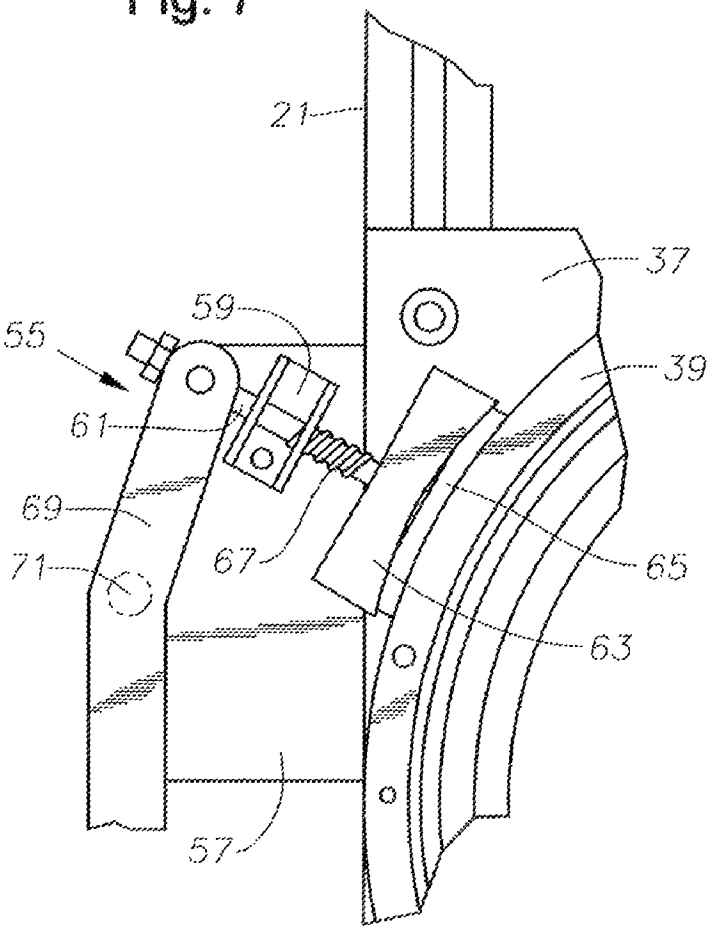
FIG. 7 is an enlarged view of a brake for the bed assembly of FIG. 1.

Referring to FIG. 7, a brake 55 controls rotation of rotatable plate 39. Brake 55 is mounted to a bracket 57 that is attached to one of the frame members 21. A short, upward-facing channel 59 is stationarily secured to a horizontal portion of bracket 57. A brake rod 61 extends through aligned holes in channel 59. Brake rod 61 is secured to a pad holder 63 that holds a brake pad 65. Brake pad 65 engages the outer circular perimeter of upper hearing strip 46 (FIG. 15) while in the engaged position. A coiled spring 67 encircles rod 61 and urges brake pad 65 against the perimeter of upper bearing strip 46 to prevent rotation of rotatable plate 39. A brake arm 69 has one end pivotably secured to an outer end of rod 61. Arm 69 is pivotably mounted by a pivot pin 71 to brake bracket 57.

Pushing a free end portion of brake arm 69 inward causes arm 69 to pivot about pivot pin 71 and pull brake rod 61 outward. This causes brake pad 65 to release its frictional engagement with the perimeter of upper bearing strip 46, allowing free rotation of rotatable plate 39. When the free end of brake arm 69 is released, spring 67 will force brake pad 65 back into braking engagement. Numerous other designs for brakes are feasible.

Referring to FIG. 2, a number of cord clamps 73 are mounted along the straight sides 53 of bed 47. Each cord clamp 73 has a movable hinged clamp member 74 for clamping one or more flexible links, which may include electrical cords or leads 75 (FIG. 1). Cords 75 typically have electrical conductor wires for connection between sensors and instruments for monitoring conditions of the patient. Cord clamps 73 will rotate in unison with bed 47 and rotatable plate 39.

Figure 8:
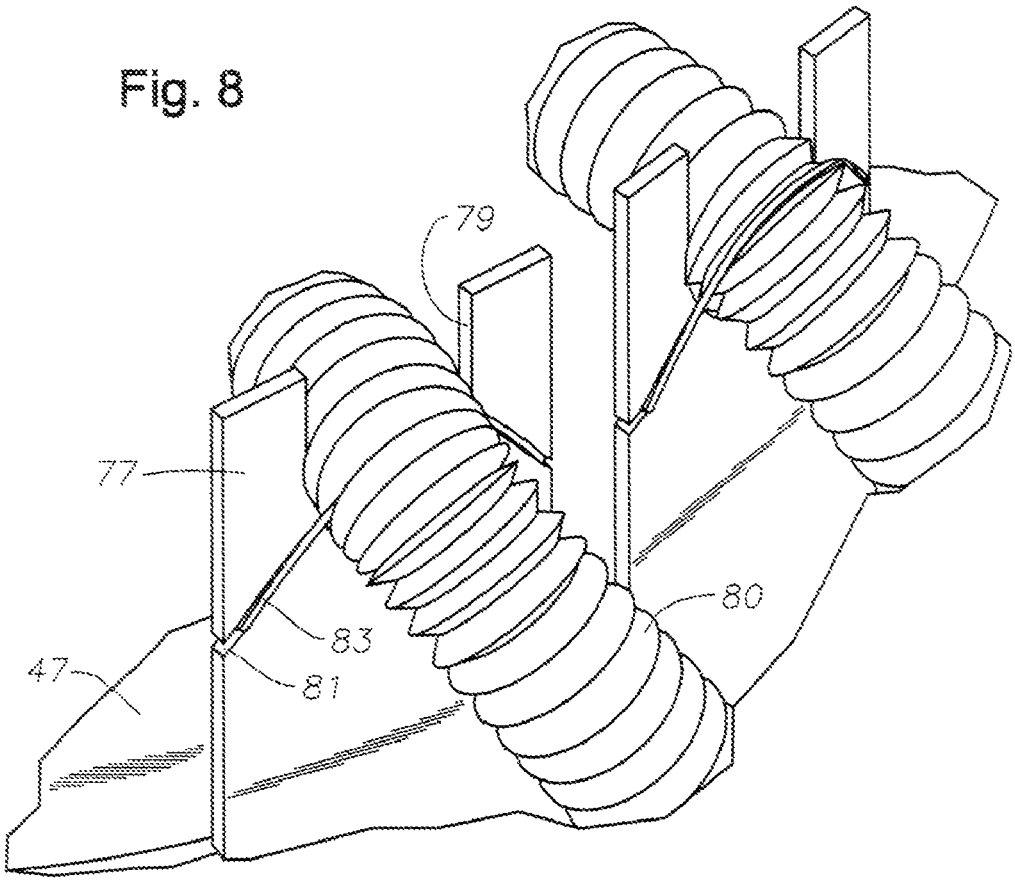
FIG. 8 is a perspective view of two tube or hose supports of the bed assembly of FIG. 1.

Also, as shown in FIG. 1, at least one tube or hose support 77 is mounted to an edge of bed 47. FIGS. 2 and 3 show a single hose support 77 mounted on each curved edge 51, while FIGS. 1 and 8 show two side-by-side hose supports 77. In this example, each hose support 77 comprises a flat vertical plate with an open slot 79 on its upper end. A tube or hose 80 locates within open slot 79 and comprises another flexible link between the patient and a medical device. Hose 80 is normally used to deliver to the patient various gases, such as oxygen or other uses used in conjunction with anesthesia. The flexible links also may include tubes for delivering liquids, which may also be located in open slot 79, or if small enough in diameter, within cord clamps 73. In this embodiment, each vertical side edge of each hose support 77 has an upward inclined slit 81, as shown in FIG. 8. Slits 81 retain an elastomeric or rubber band 83 stretched over hose 80 as shown in FIG. 8.

In the operation of the embodiment of FIGS. 1-8, medical assistants connect small patient bed assembly 11 to operating table 13 by positioning jaw 33 below operating table side rail 15 and position cross member 19 above. The assistant rotates handle 25 clockwise to lock toggle clamp assembly 17 in place, so that operating table side rail 15 cantilever-supports bed assembly 11. Bed 47 will be in a plane parallel with the plane of the patient-supporting surface or bed of operating table 13. Operating room personnel place the patient on mattress pad 49 and connect the various flexible links, such as cords 75 and hoses 80 to the patient. The cords 75 and hoses 80 will pass through central holes 41 to below bed assembly 11 so that they do not hamper rotation of bed 47. The medical assistant routes cords 75 and hoses 80 into central holes 41 by rotating rotatable plate 39 until its slot 42 is aligned with slot 38 of stationary plate 37, as shown in FIG. 5. The medical assistant pushes the bundles of chords 75 and hoses 80 through slots 38, 42 and into holes 41 by depressing tabs 44. Tabs 44 flex to allow entry of the bundle, then flex back to the closed position of FIG. 5 to prevent the any of the chords 75 or hoses 80 from working its way back out of holes 41.

The medical personnel may elevate auxiliary bed 47 to a desired position by elevating operating table 13 in a conventional manner. If tilting in fore and aft directions is desired, the assistant tilts the bed of operating table 13 conventionally, which causes bed assembly 11 to tilt in unison to the same inclination.

The physician begins the surgical procedure while bed 47 is oriented in a particular position. When the physician needs access to another position, the physician or one of the medical assistants will depress brake arm 69, which releases brake pad 65, allowing the assistant to manually rotate bed 47 and rotatable plate 39 to a different position. If needed, the assistant may continuously rotate bed 47 during part of the surgery while the physician performs the medical procedure. If so, the assistant will continue depressing brake arm 69, because when released, brake arm 69 moves back to the braking position in this embodiment. To avoid over-twisting cords 75 and hoses 80, the assistant may rotate bed 47 less than one full turn in each direction. Preferably, the rotation in any particular direction is no more than 180 degrees or one-half turn. When the medical procedure has been completed, and the auxiliary bed assembly 11 is no longer needed, operating room personnel release the assembly with toggle clamp 17 and store it away from the main operating table 13.

Figure 9:
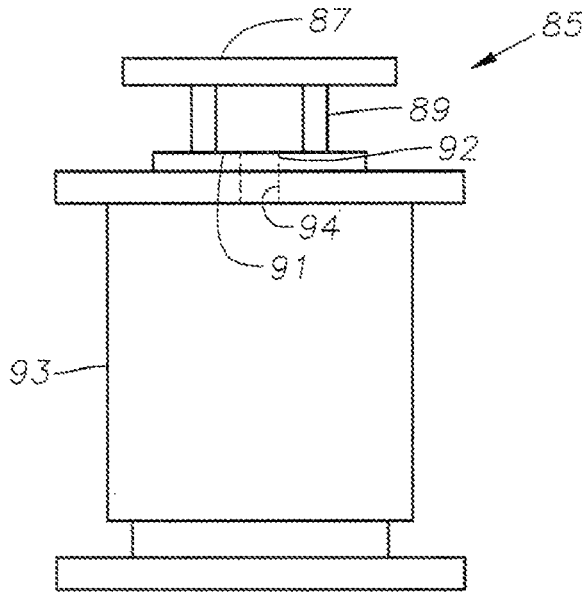
FIG. 9 is a schematic view of another embodiment of a bed assembly constructed in accordance with this invention.
Figure 11:
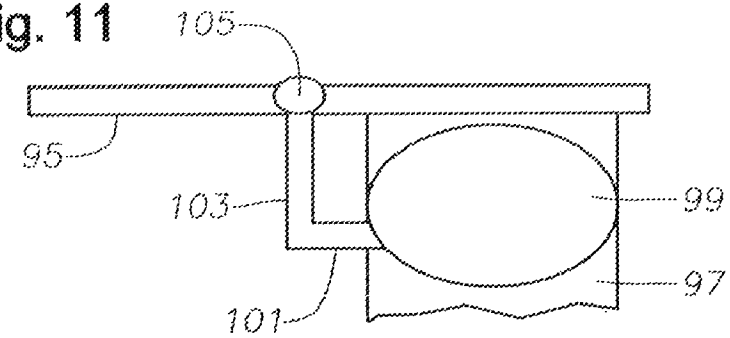
FIG. 11 is a side view of the bed assembly of FIG. 10, shown in the storage position.

In the embodiment of FIG. 9, bed assembly 85 has a rotatable bed 87 supported on columns 89 above a turntable assembly 91. Turntable assembly 91 has an upper rotatable plate supported on a lower stationary plate by bearings (not shown) as in the first embodiment. Columns 89 and bed 87 will rotate in unison with the upper rotatable plate of turntable assembly 91. Turntable assembly 91 may have a central hole 92 in its rotatable and stationary plates for routine flexible links such as cords and hoses (not shown). Rather than mount bed assembly 85 to a conventional operating table as in the first embodiment, bed assembly 85 is permanently mounted on its own vertical support 93. Vertical support 93 may comprise a plurality of legs or a single pedestal. In either type, vertical support 93 may optionally be adjustable to various heights. Also, if desired vertical support 93 may allow tilting of bed assembly 85 either by manual or electromechanical means. If turntable 91 has a central hole 92, vertical support 93 would preferably also have a hole 94 that registers with central hole 92 for routing flexible links. Hole 94 would have an access slot extend to its perimeter for routing flexible links.

In the embodiment of FIGS. 10-13, operating or surgical table 95 may be a conventional type similar to operating table 13 (FIG. 1). Operating table 95 has a vertical support member 97 that elevates and optionally tilts operating table 95. Auxiliary or small patient bed 99 is permanently mounted to operating table 95 in this embodiment, but has a storage position, shown in FIGS. 10 and 11, and an operational position, shown in FIGS. 12 and 13. The auxiliary table arrangement preferably has a turntable 107 made up of a stationary and a rotating plate in the same manner as described in connection with the other embodiments. A standoff, such as columns 109 between bed 99 and turntable 107 may be employed. As in the other embodiments, the patient-supporting surface of auxiliary bed 99 is rotatable relative to operating table 95. Also, preferably a brake and clamps and supports for hoses and cords are incorporated with the embodiment in FIGS. 10-13. A central hole 111 extends through the rotatable and stationary components of turntable 107 for routing the flexible links from medial devices to the patient. Hole 111 preferably has an access slot and retaining tabs as previously described in connection with the first embodiment.

In this embodiment, the connector between auxiliary bed 99 and operating table 95 includes a frame 101 on which turntable 107 is mounted. Frame 101 is mounted by a swivel connection 105 to a side edge of operating table 95.

Figure 13:
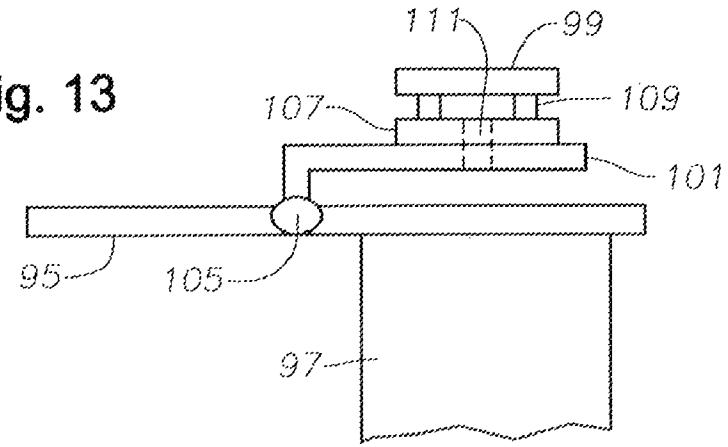
FIG. 13 is a side view of the bed assembly of FIG. 10, shown in the operational position.
Figure 10:
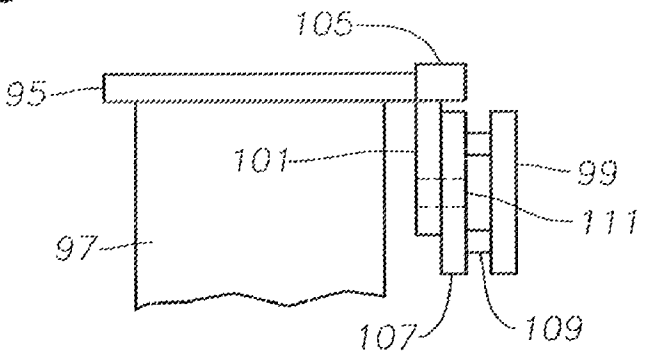
FIG. 10 is a schematic end view of another embodiment of a bed assembly in accordance with this invention, and shown in a storage position.
Figure 12:
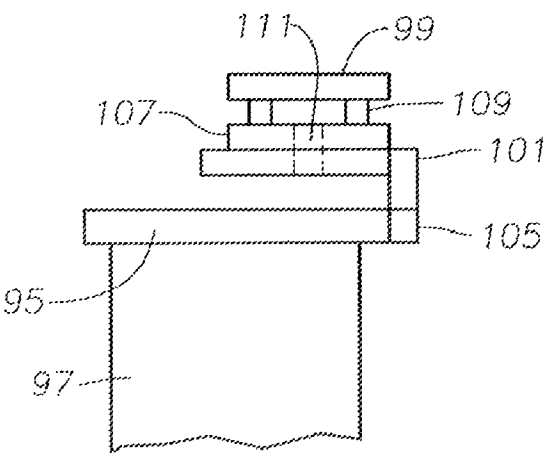
FIG. 12 is an end view of the bed assembly of FIG. 10, shown in an operational position.

In the operation of the embodiments of FIGS. 10-13, while in the storage position, turntable auxiliary bed 99 is oriented vertically in a plane perpendicular to and alongside the patient-supporting surface of operating table 95. For the operational position, the user lifts bed 99 and swivels frame 101 to position frame 101, turntable 107 and bed 99 above operating table 95 as shown in FIGS. 10, 12 and 13. Auxiliary bed 99 will be supported by operating table 95 in cantilever fashion by frame 101. In the operational position, auxiliary bed 99 may be spaced directly above and parallel with the bed of operating table 95. Flexible links such as hoses and electrical leads are routed through hole 111 and below frame 101.

The invention has significant advantages. The rotatable bed allows the physician to remain in a stationary position while rotating the patient to a desired orientation. The rotatable feature reduces awkward positions required of the physician and reduces discomfort. The rotatable feature reduces the chance of tubes, hoses and cords from becoming dislodged from attachment to the patient, which can cause injury. The central holes, access slots and retaining tabs facilitate routing the flexible links between the patient and various medical devices. The physician or medical assistants are able to rotate the small patient bed while the patient is fully supported by the bed. In addition, if attached to a conventional operating table, the auxiliary table can be tilted in various positions and adjusted vertically to accommodate physicians of different heights, which allows the surgeon to operate from either sitting or standing positions. The auxiliary table is useful not only with human patients but also with small animals. In one embodiment, the auxiliary table is quickly and easily attached and removed from an existing standard operating table. In another embodiment, the auxiliary table is permanently attached to the main operating table but readily stored out of the way. The brake mechanism avoids inadvertent rotation during medical procedures.

The routing of all tubes and wires through a central opening is a critical feature which allows full rotation of the patient without placing any stress where these are attached to the patient. This reduces the chance of tubes, hoses and cords becoming dislodged, which reduces the chance of injury to the patient.

While the invention has been shown in only a few of its forms, it should be apparent to those skilled in the art that it is not so limited but susceptible to various changes without departing from the scope of the invention.

The invention claimed is:

1. A method for supporting a patient for a medical procedure, comprising:

(a) providing a bed assembly having a bed surface for supporting a patient, rotatably mounting the bed assembly on a supporting member such that an axis of rotation of the bed assembly is normal to a plane containing the bed surface, (b) with a clamp, clamping the supporting member to a surgical table, and cantilever-supporting the bed assembly to the surgical table;

(c) during the medical procedure, selectively rotating the bed assembly relative to the supporting member about the axis of rotation; and (d) after completion of the medical procedure, releasing the clamp and removing the bed assembly from the surgical table.

2. The method according to claim 1, wherein:

step (c) comprises positioning the bed surface alongside the surgical table.

3. The method according to claim 1, wherein:

step (c) comprises positioning the bed surface directly over the surgical table.

4. The method according to claim 1, further comprising:

mounting a brake between the bed assembly and the supporting member, and with the brake, selectively applying friction to the bed assembly to retard rotation.

5. The method according to claim 4, further comprising biasing the brake to a braking position.

6. A method for supporting a patient for a medical procedure, comprising:

(a) providing a bed assembly having a bed surface for supporting a patient, rotatably mounting the bed assembly on a supporting member such that an axis of rotation of the bed assembly is normal to a plane containing the bed surface, (b) securing the supporting member to a surgical table and cantilever-supporting the bed assembly to the surgical table;

(c) during the medical procedure, selectively rotating the bed assembly relative to the supporting member about the axis of rotation; and (d) after completion of the medical procedure, folding the bed assembly to a storage position alongside and supported by the surgical table.

7. The method according to claim 6, wherein step (c) comprises positioning the bed assembly above the surgical table.

8. An apparatus for supporting a patient during a medical procedure, comprising:

a supporting member;

a rotatable member mounted to the supporting member for rotation about an axis of rotation relative to the supporting member, the rotatable member having a bed surface located above the supporting member for supporting a patient, the bed surface being located in a plane normal to the axis of rotation, the axis of rotation passing through the bed surface; and a clamp mounted to the supporting member for releasably mounting the supporting member and rotatable member to a surgical table.

9. The apparatus according to claim 8, wherein the supporting member and the rotatable member are adapted to be located alongside the surgical table while clamped to the surgical table and in the operational position.

10. The apparatus according to claim 8, wherein the rotatable member further comprises:

a rotatable plate mounted on the supporting member by bearings; and a plurality of columns extending between the rotatable plate and the bed surface.

11. An apparatus for supporting a patient during a medical procedure, comprising:

a supporting member;

a rotatable member mounted to the supporting member for rotation about an axis of rotation relative to the supporting member, the rotatable member having a bed surface for supporting a patient, the bed surface being located in a plane normal to the axis of rotation:

a clamp mounted to the supporting member for releasably mounting the supporting member and rotatable member to a surgical table; and a brake connected between the supporting member and the rotatable member for selectively retarding rotation of the rotatable member.

12. The apparatus according to claim 11, wherein the brake is biased to a braking position.

13. An apparatus for supporting a patient during a medical procedure, comprising:

a surgical table having a primary patient bed surface;

an auxiliary table, comprising:

a supporting member;

a clamp releasably connecting the supporting member to the surgical table;

a rotatable plate mounted on the supporting member by bearings; and an auxiliary patient bed surface mounted to the rotatable plate for rotation therewith.

14. The apparatus according to claim 13, wherein the clamp is adapted to cantilever support the auxiliary patient bed surface horizontally and alongside the primary patient bed surface.

15. The apparatus according to claim 13, further comprising:

a plurality of columns extending between the rotatable plate and the auxiliary patient bed surface.

16. The apparatus according to claim 13, further comprising:

a brake connected between the supporting member and the rotatable plate for selectively retarding rotation of the rotatable member.

17. The apparatus according to claim 16, wherein the brake is biased to a braking position.

18. An apparatus for supporting a patient during a medical procedure, comprising:

a surgical table having a primary patient bed surface;

an auxiliary table, comprising:

a supporting member;

a connector connecting the supporting member to the surgical table;

a rotatable plate mounted on, the supporting member by bearings;

an auxiliary patient bed surface mounted to the rotatable plate for rotation therewith; and the connector having an operational position wherein the auxiliary patient bed surface is above the primary patient bed surface, and a storage position wherein the auxiliary patient bed is located in a vertical plane alongside the surgical table.

19. The apparatus according to claim 18, further comprising:

a plurality of columns extending between the rotatable plate and the auxiliary patient bed surface.

20. The apparatus according to claim 18, further comprising:

a brake connected between the supporting member and the rotatable plate for selectively retarding rotation of the rotatable member.

21. An apparatus for supporting a patient during a medical procedure, comprising:

a vertically extending supporting member;

a rotatable member mounted to the supporting member for rotation about an axis of rotation relative to the supporting member, the rotatable member having a bed surface located above the supporting member for supporting a patient, the bed surface being located in a plane normal to the axis of rotation, the axis of rotation passing through the bed surface; and the supporting member being selectively tiltable relative to vertical for tilting the bed surface and the axis of rotation relative to vertical.

* * * * *